US006981934B1

(12) United States Patent
Shifferaw

(10) Patent No.: US 6,981,934 B1
(45) Date of Patent: Jan. 3, 2006

(54) MACHINE FOR DOING SQUATS AND OTHER EXERCISES

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 457 days.

(21) Appl. No.: 09/909,953

(22) Filed: Jul. 19, 2001

(51) Int. Cl.
*A63B 21/00* (2006.01)

(52) U.S. Cl. ..... 482/133; 482/92; 482/121

(58) Field of Classification Search ..... 482/132, 482/135, 95, 91, 101, 121–123, 130, 92, 482/96, 99, 102, 110, 133
See application file for complete search history.

(56) References Cited

U.S. PATENT DOCUMENTS 4,706,953 A * 11/1987 Graham ..... 482/110
5,066,005 A * 11/1991 Luecke ..... 482/130
5,263,913 A * 11/1993 Boren ..... 482/96
5,964,684 A * 10/1999 Sokol ..... 482/96

* cited by examiner

*Primary Examiner*—Glenn E. Richman
(74) *Attorney, Agent, or Firm*—Edward S. Wright

(57) ABSTRACT

Exercise machine having a platform for receiving an exerciser, a post extending from the platform, a carriage which can be moved along the post by the exerciser, and a plurality of elastic elements which can be selectively connected to the carriage to assist or resist movement of the carriage along the post. The machine is highly portable and can be folded for storage.

13 Claims, 3 Drawing Sheets

MACHINE FOR DOING SQUATS AND OTHER EXERCISES

BACKGROUND

1. Field of the Invention

This invention pertains generally to exercise machines and, more particularly, to a machine which is suitable for doing squats and other exercises.

2. Related Art

Because of the stress which they place on the knees and back, deep knee bends or squats are difficult for many people to do, and a number of people are unable to do exercises of that type.

OBJECTS AND SUMMARY OF THE INVENTION

It is in general an object of the invention to provide a new and improved exercise machine which can assist people in doing exercises such as deep knee bends or squats.

Another object of the invention is to provide an exercise machine of the above character which can also be used in exercising other parts of the body.

These and other objects are achieved in accordance with the invention by providing an exercise machine having a platform for receiving an exerciser, a post extending from the platform, a carriage which can be moved along the post by the exerciser, and a plurality of elastic elements which can be selectively connected to the carriage to assist or resist movement of the carriage along the post. The machine is highly portable and can be folded for storage.

DETAILED DESCRIPTION

Figure 1:
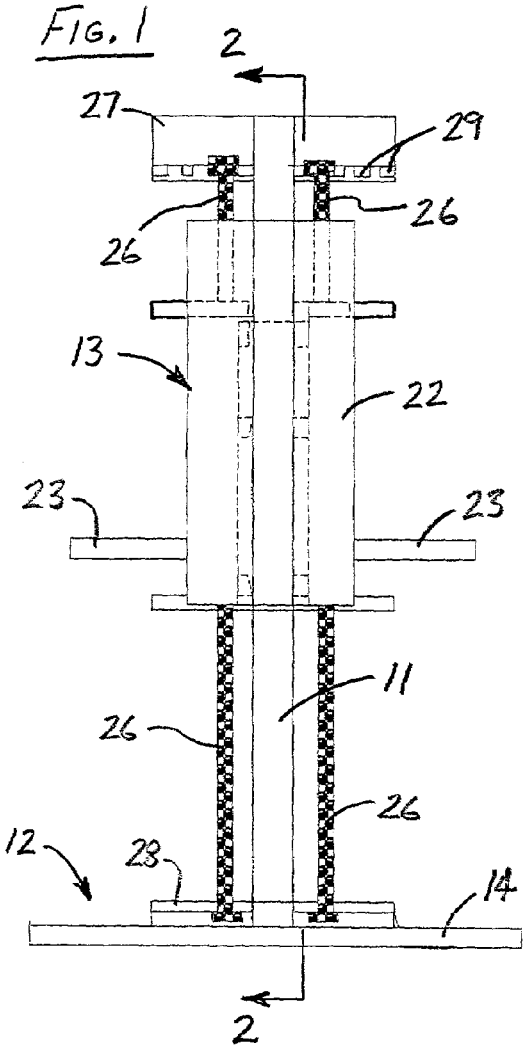
FIG. 1 is front elevational view of one embodiment of an exercise machine incorporating the invention.

As illustrated in the drawings, the machine includes an upstanding post 11 mounted on a base 12, with a carriage 13 mounted on the post for movement along it.

Figure 2:
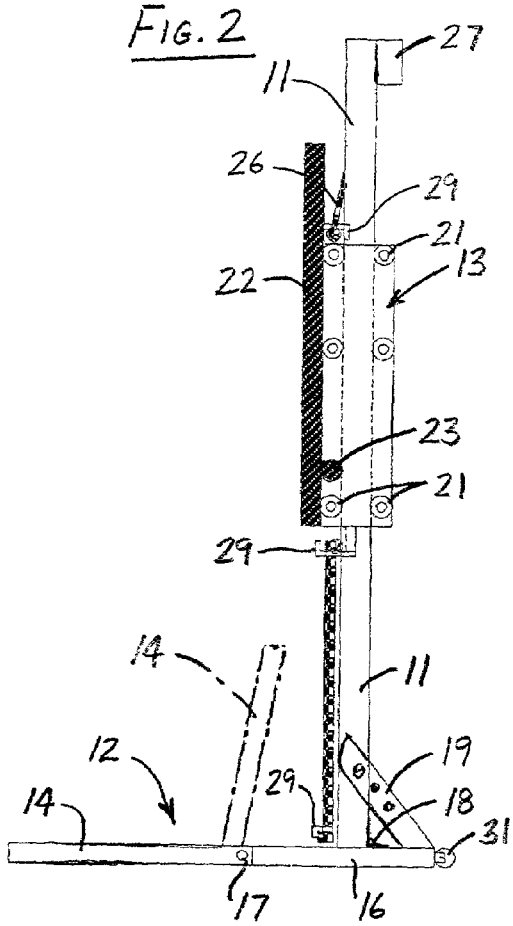
FIG. 2 is a cross-sectional view taken along line 2—2 in FIG. 1.

The base is formed in two sections 14, 16 which are joined together by a hinge 17 to form a platform for receiving a person using the machine. The two base sections are rectangular and planar, and in normal use, they rest on the floor in coplanar fashion. For transportation and storage, front section 14 can be swung up to a generally vertical position as illustrated in broken lines in FIG. 2.

Post 11 is mounted on rear base section 16 by means of a hinge 18 which allows the post to be inclined rearwardly at different angles relative to the platform. An adjustable brace 19 is connected between the base and the post for holding the post in the different positions.

Carriage 13 has rollers 21 which engage the post and permit the carriage to travel freely along it. The carriage also includes a backrest 22 for receiving the back of a person on the platform and a laterally extending bar or handles 23 which can be gripped by him.

Means is provided for selectively assisting or resisting movement of the carriage along the post in either direction. This means comprises a plurality of elastic elements 26 which are connected between the carriage and a pair of cross arms 27, 28 which are affixed to the post. Cross arm 27 is positioned above the carriage, and elastic elements connected to it assist movement of the carriage in an upward direction and resist movement in a downward direction. Cross arm 28 is positioned below the carriage, and elastic elements connected to it assist movement of the carriage in a downward direction and resist movement in an upward direction.

In one presently preferred embodiment, the elastic elements are of a type known as bungee cords. However, other types of elastic elements, including coil springs, can be used. The elastic elements are removably connected to the carriage and to the cross arms by hooks 29.

The elastic elements can be used in any desired combination or number to provide assistance for and/or resistance to movement in either direction. The amount of assistance or resistance is increased by using heavier cords or more cords, and weights (not shown) can be mounted on the handles to provide additional resistance to movement in the upward direction.

Wheels 31 are mounted to the rear of the base for use in moving the machine about. When not in use, the front section of the platform is folded up, and the machine can be tipped back onto the wheels and rolled about.

Figure 3:
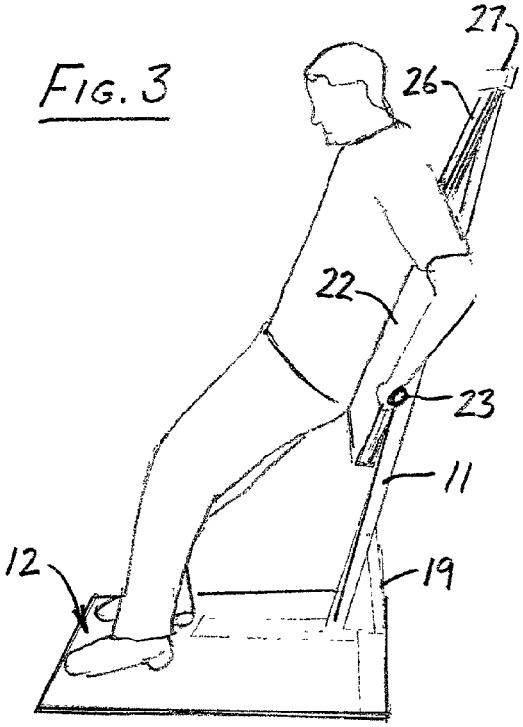
FIGS. 3–4 are operational views of the embodiment of FIG. 1, illustrating the use of the machine in doing squats.
Figure 4:
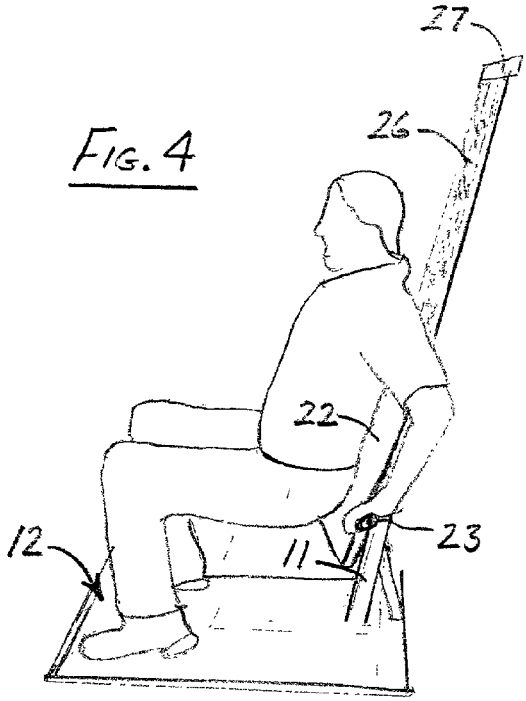

FIGS. 3–4 illustrate the use of the machine in doing squats. For this exercise, the person stands on the platform and leans back toward the post, with his back resting against backrest 22 and his hands gripping handles 23. The post is inclined at a comfortable angle which prevents stress on the back or knees, and elastic cords 26 connected between the carriage and upper cross arm 27 lift the carriage and assist the exerciser in straightening his legs as he comes up. These cords also provide resistance on the way down, which works the hamstrings and gluteus maximums.

Figure 5:
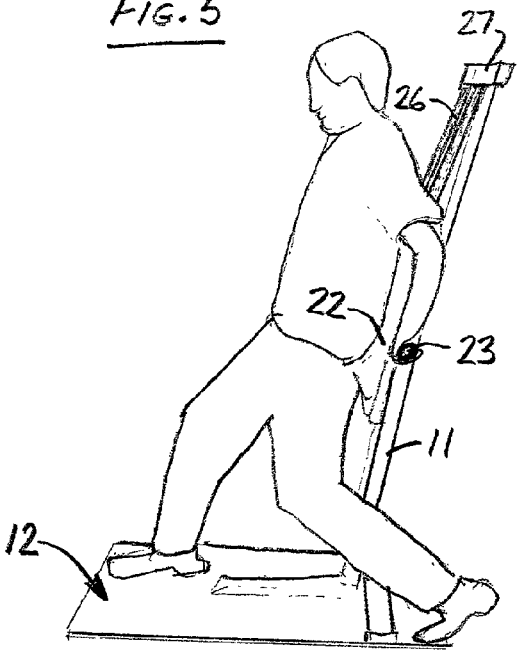
FIGS. 5–6 are operational views of the embodiment of FIG. 1, illustrating the use of the machine in doing lunges.
Figure 6:
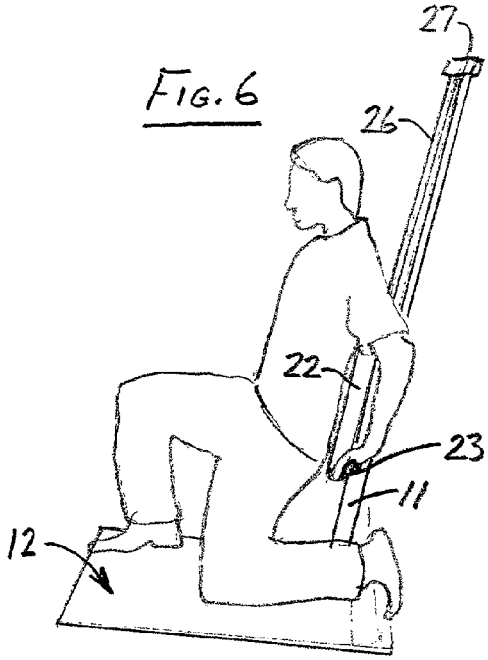

As illustrated in FIGS. 5–6, lunges are done by placing one foot toward the front of the platform and one toward the rear, with the back resting against the backrest and the hands gripping the handles. The exerciser then drops down onto the rear knee and rises again, with elastic cords 26 connected to the upper cross arm assisting the upward movement and resisting the downward movement.

Figure 7:
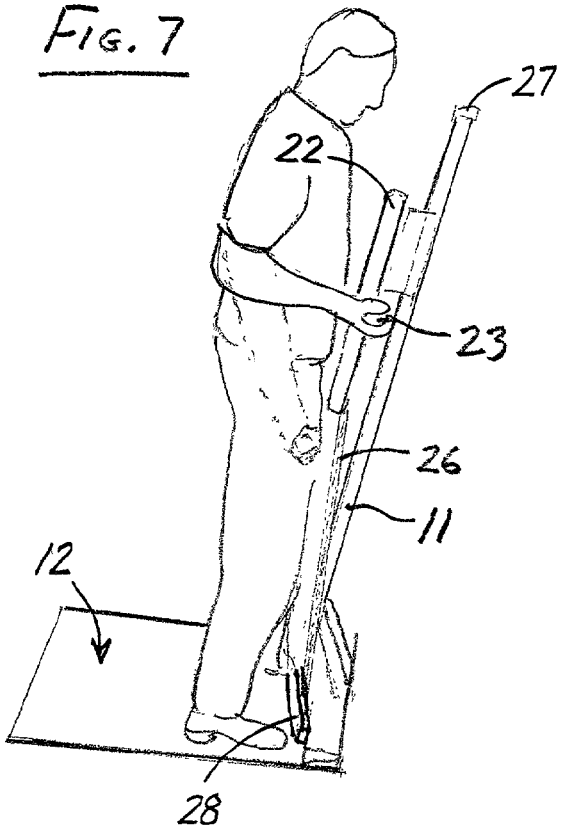
FIG. 7 is an operational view of the embodiment of FIG. 1, illustrating the use of the machine in doing biceps curls.

To do biceps curls, the exerciser stands on the platform facing the post, with his hands gripping the handles from below, as shown in FIG. 7. Cords 26 connected between the carriage and the lower cross arm resist upward movement of the exerciser's arms as they pivot about the elbows.

Figure 8:
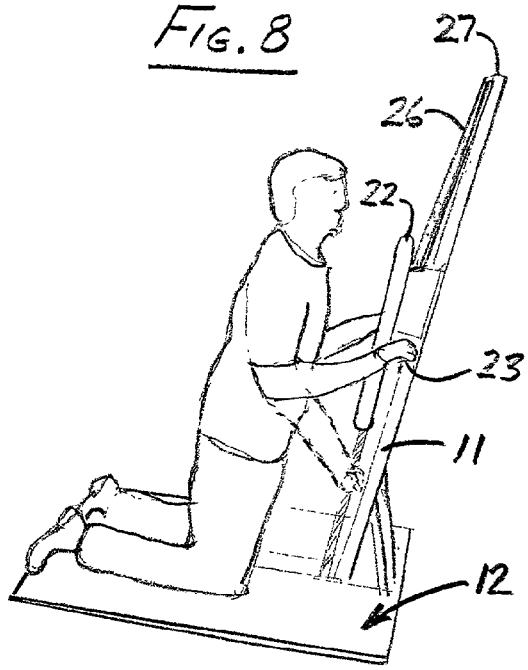
FIG. 8 is an operational view of the embodiment of FIG. 1, illustrating the use of the machine in doing triceps extensions.

For triceps extensions, the exerciser kneels on the platform facing the post, with his hands gripping the handles from above, as shown in FIG. 8. Cords 26 connected between the upper cross arm and the carriage resist movement of the arms in the downward direction as they pivot about the elbows.

The invention has a number of important features and advantages. It enables people who otherwise could not do so to do multiple repetitions of deep knee bends or squats, and it can also be used in other exercises for the arms, legs, shoulders and back. It can provide assistance as well as resistance, and the amount of assistance or resistance is readily adjusted simply by changing the number and position of the elastic cords. The machine is relatively compact, and is easily stored in a closet or under a bed when not in use.

It is apparent from the foregoing that a new and improved exercise machine has been provided. While only one presently preferred embodiment has been described in detail, as will be apparent to those familiar with the art, certain changes and modifications can be made without departing from the scope of the invention as defined by the following claims.

What is claimed is:

1. An exercise machine comprising: a horizontally extending platform for receiving an exerciser, an upright post mounted on the platform, a carriage which can be moved along the post in upward and downward directions by the exerciser, and a plurality of elastic elements which can be selectively connected to the carriage to assist or resist movement of the carriage in the upward and downward directions.

2. The exercise machine of claim 1 wherein the carriage includes a backrest for receiving the back of the exerciser on the platform.

3. The exercise machine of claim 1 wherein the carriage includes a handle adapted to be gripped by the exerciser.

4. The exercise machine of claim 1 wherein the post is inclined at an angle relative to the platform.

5. The exercise machine of claim 4 wherein the angle between the post and the platform is adjustable.

6. The exercise machine of claim 1 including a plurality of rollers which mount the carriage to the post for rolling movement along the post.

7. The exercise machine of claim 1 wherein the elastic elements are bungee cords.

8. An exercise machine comprising: a horizontally extending platform for receiving an exerciser, an upright post mounted on the platform, a carriage which can be moved along the post in upward and downward directions by the exerciser, horizontally extending arms affixed to the post above and below the carriage, and a plurality of elastic elements which can be selectively connected between the carriage and the arms to assist or resist movement of the carriage in the upward and downward directions.

9. The exercise machine of claim 8 wherein the elastic elements are bungee cords.

10. An exercise machine comprising: a base including a platform formed in two sections which are hinged together for movement between an operational position in which both of the sections extend in a horizontal direction and a storage position in which one of the sections is folded at an angle relative to the other, a post mounted on the platform and extending in an upright direction when the machine is in use and the platform sections extend horizontally, a carriage which can be moved along the post in upward and downward directions by an exerciser, a plurality of elastic elements which can be selectively connected to the carriage to assist or resist movement of the carriage along the post, and wheels attached to the base for use in moving the machine about.

11. The exercise machine of claim 10 wherein the post is hingedly connected to one of the platform sections, and a brace is connected between the post and the base for holding the post at different angles relative to that platform section.

12. The exercise machine of claim 10 wherein the elastic elements are bungee cords.

13. The exercise machine of claim 1 wherein the platform is adapted to rest on a horizontally extending supporting surface, and the post is supported by the platform.

* * * * *